US011952728B2

(12) United States Patent
Wei et al.

(10) Patent No.: US 11,952,728 B2
(45) Date of Patent: Apr. 9, 2024

(54) ROAD STRUCTURE RECONSTRUCTED FROM LARGE-SCALE INDEPENDENT UNDERGROUND GARAGE AND CONSTRUCTION METHOD THEREOF

(71) Applicant: HANGZHOU CITY UNIVERSITY, Zhejiang (CN)

(72) Inventors: Gang Wei, Hangzhou (CN); Tianbao Xu, Hangzhou (CN); Jiaxuan Zhu, Hangzhou (CN); Yunliang Cui, Hangzhou (CN); Bing Li, Hangzhou (CN); Ke Wang, Hangzhou (CN); Pengfei Xiang, Hangzhou (CN); Shuangyan Lin, Hangzhou (CN); Xinquan Wang, Hangzhou (CN); Hongguo Diao, Hangzhou (CN)

(73) Assignee: HANGZHOU CITY UNIVERSITY, Hangzhou (CN)

( * ) Notice: Subject to any disclaimer, the term of this patent is extended or adjusted under 35 U.S.C. 154(b) by 0 days.

(21) Appl. No.: 18/351,482

(22) Filed: Jul. 12, 2023

(65) Prior Publication Data

US 2023/0357993 A1 Nov. 9, 2023

Related U.S. Application Data

(63) Continuation of application No. PCT/CN2022/127356, filed on Oct. 25, 2022.

(30) Foreign Application Priority Data

Feb. 16, 2022 (CN) ..... 202210140501.4

(51) Int. Cl.
*E01C 1/02* (2006.01)
*E01C 1/00* (2006.01)
(Continued)

(52) U.S. Cl.
CPC ..... *E01C 1/002* (2013.01); *E01C 11/224* (2013.01); *E01C 23/00* (2013.01); *E04G 23/0285* (2013.01)

(58) Field of Classification Search
CPC ..... E01C 1/002; E01C 11/224; E01C 23/00; E04G 23/0285
(Continued)

(56) References Cited

U.S. PATENT DOCUMENTS 1,340,325 A * 5/1920 Caulkins ..... B64F 1/36 404/1
1,629,787 A * 5/1927 Hackett ..... E01D 1/00 404/1
(Continued)

FOREIGN PATENT DOCUMENTS

CN 1693591 A 11/2005
CN 104099943 A 10/2014
(Continued)

OTHER PUBLICATIONS

International Search Report (PCT/CN2022/127356); dated Dec. 29, 2022.

*Primary Examiner* — Raymond W Addie
(74) *Attorney, Agent, or Firm* — W&G Law Group

(57) ABSTRACT

A road structure reconstructed from large-scale independent underground garage and a construction method, which solves the problem of a newly constructed urban expressway passing through large underground space. The technical point is a construction method for the road structure reconstructed from large-scale independent underground garage, including the following steps: S100: segmentation for the garage, S200: preparation before construction: the materials and equipment required for construction are transported to the site, and the construction site is cleaned, S300: reconstruction for the front section, S400: reconstruction for the
(Continued)

middle section, S500: reconstruction for the rear section. The inventiveness of the present disclosure is the application of segmentation construction, the front section is completely obsoleted, a transition section is provided at the middle, and the design of the rear section adopts a double-deck road, thus the original underground garage structure is fully utilized.

7 Claims, 6 Drawing Sheets

(51) Int. Cl.
*E01C 11/22* (2006.01)
*E01C 23/00* (2006.01)
*E04G 23/02* (2006.01)

(58) Field of Classification Search
USPC ..... 404/1, 72
See application file for complete search history.

(56) References Cited

U.S. PATENT DOCUMENTS 1,682,679 A * 8/1928 Lawton ..... E04H 6/10 404/1
1,748,309 A * 2/1930 Rose ..... B61F 9/00 404/1
1,784,728 A * 12/1930 Harriss ..... E01C 1/04 404/1
2,160,315 A * 5/1939 Prince ..... E01C 1/04 404/1
3,366,020 A * 1/1968 Reinitzhuber ..... E01C 9/083 404/1
4,954,035 A * 9/1990 Strebel ..... E04H 6/08 414/233
8,915,669 B1 * 12/2014 Gustafson ..... B61B 1/00 404/1
10,337,202 B1 * 7/2019 Vaghi ..... E01C 1/002
10,486,073 B1 * 11/2019 Weiner ..... E01D 18/00
2008/0038054 A1 * 2/2008 Gustafson ..... E01C 1/002 404/1
2014/0205376 A1 * 7/2014 Derenoncourt ..... E01C 1/02 404/1

FOREIGN PATENT DOCUMENTS

CN 114439267 A 5/2022
FR 2955878 A1 8/2011
JP 032470 A 1/1991
KR 20210102867 A 8/2021

* cited by examiner

ROAD STRUCTURE RECONSTRUCTED FROM LARGE-SCALE INDEPENDENT UNDERGROUND GARAGE AND CONSTRUCTION METHOD THEREOF

CROSS-REFERENCE TO RELATED APPLICATIONS

The present application is a continuation of International Application No. PCT/CN2022/127356, filed on Oct. 25, 2022, which claims priority to Chinese Application No. 202210140501.4, filed on Feb. 16, 2022, the contents of both of which are incorporated herein by reference in their entireties.

TECHNICAL FIELD

The present disclosure relates to the technical field of engineering construction of underground space reconstruction and in particular, to a road structure reconstructed from large-scale independent underground garage and a construction method thereof.

BACKGROUND

With the urban development, the coverage of urban roads in cities gradually increases, and road construction is an indispensable part of urban construction. When a new road, such as an urban expressway, passes through the area within a large-scale independent underground garage, a large amount of vehicle load is generated, and even a certain soil-filled height appears. The original independent underground garage cannot continue to be used normally due to vibrations and a large amount of additional loads.

Facing such situations, based on traditional technology, the original large-scale independent underground garage is generally directly destroyed, and then filled with soil layers to construct the road. However, the above approach not only requires a large amount of project and a long construction period, but also causes huge resource waste. Another approach is to fill the original large-scale independent underground garage with soil, and then construct the new road. However, due to the settlement of the soil, the filled soil exerts tremendous earth pressure on the surrounding environment. Accordingly, gaps will be generated between the top of the soil and the roof plate of the original large-scale independent underground garage, and the strength of the soil is also greatly affected, such that the bearing capacity of the road will decrease and people's travel safety will be affected, which is obviously unreasonable.

The above approaches are not applicable for roads passing through areas with large-scale independent underground garages. Therefore, it is necessary to develop a road structure applicable for passing through areas with large-scale independent underground garages and a construction method.

SUMMARY

The purpose of the present disclosure is to overcome the shortcomings of traditional technology and provide a road structure reconstructed from large-scale independent underground garage and a construction method.

The road structure reconstructed from large-scale independent underground garage includes a front straight section, a middle transition section, and a rear double-deck road section. A settlement joint is provided between the front straight section and the middle transition section, and a settlement joint is provided between the middle transition section and the rear double-deck road section.

For the reconstruction for the front straight section, a drainage hole provided in the floor plate, graded crushed stones are provided on the top of the floor plate, foamed concrete is provided on the top of the graded crushed stones, both sides of the foamed concrete filled in blocks are fixedly connected to wood formworks, bitumastic oakum flexible material are filled in adjacent wood formworks. The top of the foamed concrete is fixedly connected to a roof plate, a waterproof membrane is laid on the top of the roof plate, a clay layer is provided on the top of the waterproof membrane, slag is provided and filled in layers on the top of the clay layer, a central drainage pipeline is provided inside the slag, and longitudinal drainage pipelines buried at both sides of the slag. A transversal drainage pipeline is provided between the central drainage pipeline and the longitudinal drainage pipelines, and the upper of the slag is fixedly connected to a road structure layer. A partially preserved garage is provided on the left side of the front straight section, and a settlement joint is provided between the partially preserved garage and a reconstructed partially underground garage. The reconstructed partially underground garage includes frame columns, and a steel reinforced concrete sealing wall is provided along the frame columns. Rebars are embedded inside the frame columns, the floor plate, and the roof plate to form a steel reinforcement cage. An upper support is provided under the roof plate, and a lower support is provided on the floor plate. The upper support and the lower support are fixedly connected to the steel reinforcement cage to form a steel reinforced concrete sealing wall. A partition wall is provided at the right side of the settlement joint, and the waterproof membrane is laid between the right side of the partition wall and the wood formworks. A side wall of the original underground garage is provided at the right side of the front straight section, and fixedly connected to the floor plate and the road structure layer.

For the reconstruction for the middle transition section, a hole is provided on the floor plate as the drainage hole, the graded crushed stones are provided at the top of the floor plate, the foamed concrete is provided at the top of the graded crushed stones, the clay layer is laid on the top of the foamed concrete, the slag is provided and filled in layers on the top of the clay layer, the central drainage pipeline is provided inside the slag, and the longitudinal drainage pipelines buried at both sides of the slag. The transversal drainage pipeline is provided between the central drainage pipeline and the longitudinal drainage pipelines, and the upper part of the slag is fixedly connected to the road structure layer. The partially preserved garage is provided on the left side of the middle transition section, the settlement joint is provided between the partially preserved garage and the reconstructed partially underground garage, and the partition wall is provided at the right side of the settlement joint. The side wall of the original underground garage is provided at the right side of the middle transition section, and fixedly connected to the floor plate and the road structure layer. The settlement joint includes foaming agent, cement mortar mixed with lost circulation material is laid above the foaming agent, a waterstop strip is fixedly connected to the top of the cement mortar mixed with lost circulation material, the waterproof membrane is fixedly connected to the top of the waterstop strip, and the wood formworks are fixedly connected to the top of the waterproof membrane.

For the reconstruction for the rear double-deck road section, rebars are embedded inside the frame columns. The partition wall is provided along the direction of the road, and the upper side of the partition wall is fixedly connected to a girder in the transverse direction. An upper side of the roof plate is fixedly connected to an upper plate and a lower of the roof plate is fixedly connected to a lower plate, respectively. A concrete layer, the slag, and the road structure layer are laid on the upper plate from bottom to top in sequence. The concrete layer is provided with a central drainage pipeline therein, and with the longitudinal drainage pipelines buried on both sides thereof, and the transversal drainage pipeline is provided between the central drainage pipeline and the longitudinal drainage pipelines. A road structure subcrust, a concrete base, a coarse asphalt lower surface course, and a fine asphalt surface course are laid on the floor plate in sequence. A lower layer drainage system is located inside the concrete base, and includes a lower layer horizontal drainage pipe, a lower layer longitudinal drainage pipe, and an inspection well. The lower layer horizontal drainage pipe is laid perpendicular to the direction of the road, the lower layer longitudinal drainage pipe is laid along both sides of the direction of the road, and the inspection well is provided at the connection part of the lower layer horizontal drainage pipe and the lower layer longitudinal drainage pipe. The partially preserved garage is provided at the left side of the rear double-deck road section, and the settlement joint is provided between the partially preserved garage and the reconstructed partially underground garage. The partition wall is provided at the right side of the settlement joint, the side wall of the original underground garage is provided at the right side of the rear double-deck road section, and the side wall of the original underground garage is fixedly connected to the floor plate and the road structure layer.

The construction method for the road structure reconstructed from large-scale independent underground garage, including the following steps:

S100: segmentation for the large-scale underground garage: a size and a number of segments are determined, based on the structural bearing capacity, surrounding environment of the garage, soil quality, and the importance of a newly constructed road crossing an existing large-scale independent underground garage.

S200: preparation before construction: materials and equipment required for construction are transported to a site, and the construction site is cleaned.

S300: reconstruction for a front section of the large-scale independent underground garage: according to construction requirements, a roof plate of the original underground garage is preserved and the front straight section is reconstructed.

S400: reconstruction for the middle section of the large-scale independent underground garage: according to the construction requirements, the roof plate and internal columns of the original underground garage is demolished, and the middle transition section is reconstructed.

S500: reconstruction for the rear section of the large-scale independent underground garage: according to the construction requirements, the rear section road is reconstructed into a double-deck road.

The special features and beneficial effects of the present disclosure are as follows:

1. The inventiveness of the present disclosure is the application of segmentation construction, the reconstruction for the front section adopts complete disposal, a transition section is provided at the middle, and the design of the rear section adopts a double-deck road, each section corresponds to a plan according to actual conditions, which greatly improves the bearing capacity and service life of the road structure, and greatly alleviates the situation of urban traffic congestion.

2. In the reconstruction of the present disclosure, the designed new settlement joint effectively reduce the impact of uneven settlement of the foundation caused by the reconstruction, which is very conducive to the stability and safety of the structure.

3. In the reconstruction of the present disclosure, the foamed concrete material is selected for filling, which can reduce the load and settlement on the one hand, and on the other hand, can make the filling very compact and fully support the upper road structure.

4. In the reconstruction of the present disclosure, the designed double-deck road above and below the ground not only fully utilizes the existing underground space structure, but also saves resources and reduces costs.

Figure 1:
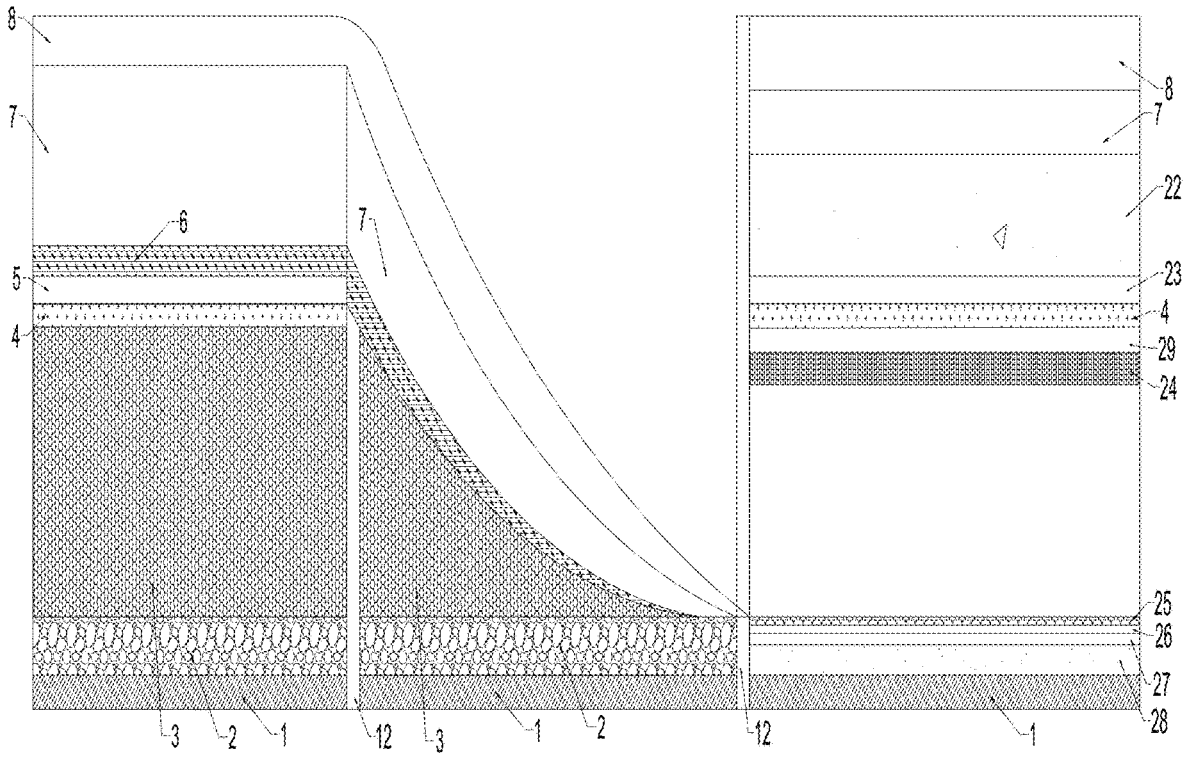
FIG. 1 is a longitudinal sectional view of a road reconstructed from large-scale independent underground garage.

Reference signs: 1—floor plate, 2—graded crushed stones, 3—foamed concrete, 4—roof plate, 5—waterproof membrane, 6—clay layer, 7—slag, 8—road structure layer, 9—central drainage pipeline, 10—longitudinal drainage pipelines, 11—partition wall, 12—settlement joint, 13—frame columns, 14—transversal drainage pipeline, 15—drainage hole, 16—wood formwork, 17—bitumastic oakum flexible material, 18—rebars, 19—side wall of the original underground garage, 20—partially preserved garage, 21—steel reinforced concrete sealing wall, 22—concrete layer, 23—upper plate, 24—girder, 25—fine asphalt surface course, 26—coarse asphalt lower surface course, 27—concrete base, 28—road structure subcrust, 29—lower plate, 30—lower support, 31—steel reinforcement cage, 32—foaming agent, 33—cement mortar mixed with lost circulation material, 34—waterstop strip, 35—reconstructed partially underground garage, 36—exterior wall, 37—upper support, 38—lower layer longitudinal drainage pipe, 39—inspection well, 40—lower layer drainage system, 41—lower layer horizontal drainage pipe.

DESCRIPTION OF EMBODIMENTS

In the reconstruction of a front section of the present disclosure, by filling the top of the graded crushed stones 2 with foamed concrete 3, on the one hand, the load and settlement can be reduced, on the other hand, the foamed concrete 3 can fill very compactly, and fully bear the upper road structure. A waterproof membrane 5 is laid on the top of a roof plate 4. The waterproof membrane 5 is made of modified asphalt waterproof membrane, which can effectively prevent the erosion of the foamed concrete 3. An upper support 37 and a lower support 30 are provided at the corners of the roof plate 4 and a floor plate 1, respectively, so as to prevent the instability of the right angle structure formed by pouring a steel reinforcement cage 31, and to better resist the horizontal force generated by underground garage and partially preserved garage 20.

In the reconstruction of a middle section of the present disclosure, the bottom layer of the settlement joint 12 is filled with foaming agent 32, and a polymer cement waterproof adhesive is used for waterproofing on the bottom layer. Then, cement mortar mixed with lost circulation material 33 is used for fixation, and a waterstop strip 34 is buried to further strengthen the expansion capacity. Afterwards, the polymer cement mortar is used for plastering, and the waterproof membrane 5 is used for double-layer V-shaped exterior wall protection on the plastering surface. The outermost layer is protected with wood formworks 16.

In the reconstruction of a rear section of the present disclosure, a concrete layer 22, slag 7, and a road structure layer 8 are laid on the upper layer of the road, and a road structure subcrust 28, a concrete base 27, a coarse asphalt lower surface course 26, and a fine asphalt surface course 25 are laid on the lower layer of the road. Each layer should be compacted before laying the next layer, which can fully improve the bearing capacity of the road structure. The reconstruction using double-deck road achieves vehicle diversion and greatly alleviates the situation of urban traffic congestion.

The above measures can ensure the construction quality of the road structure reconstructed from large-scale independent underground garage.

Example 1

FIG. 1 is a schematic diagram of the longitudinal section of the road structure reconstructed from large-scale independent underground garage.

Figure 2:
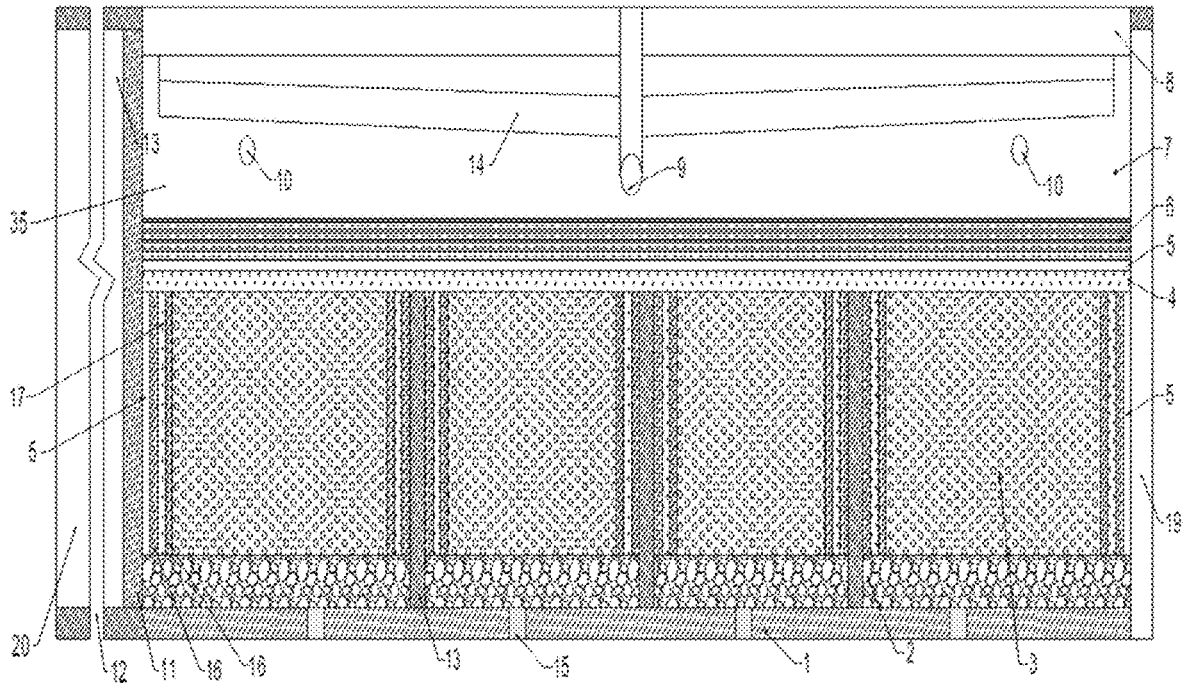
FIG. 2 is a transversal sectional view of a front section of the road reconstructed from large-scale independent underground garage.
Figure 5:
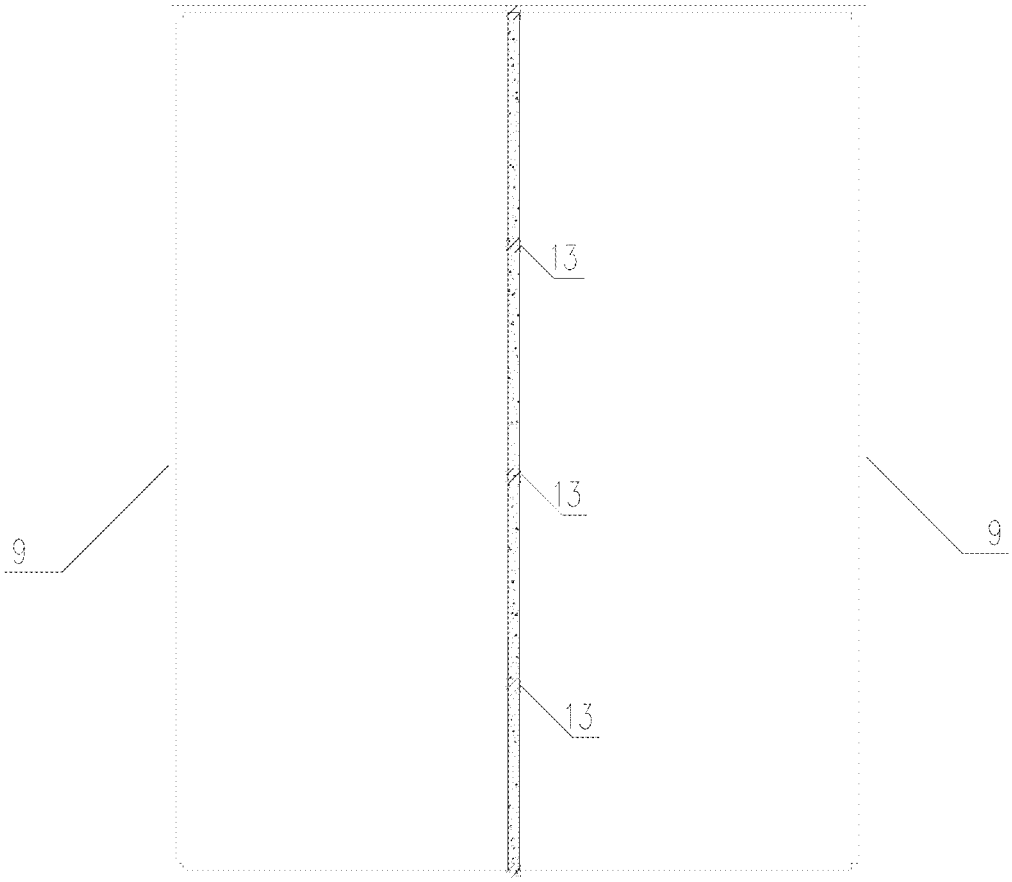
FIG. 5 is a top view of the road reconstructed from large-scale independent underground garage.
Figure 6:
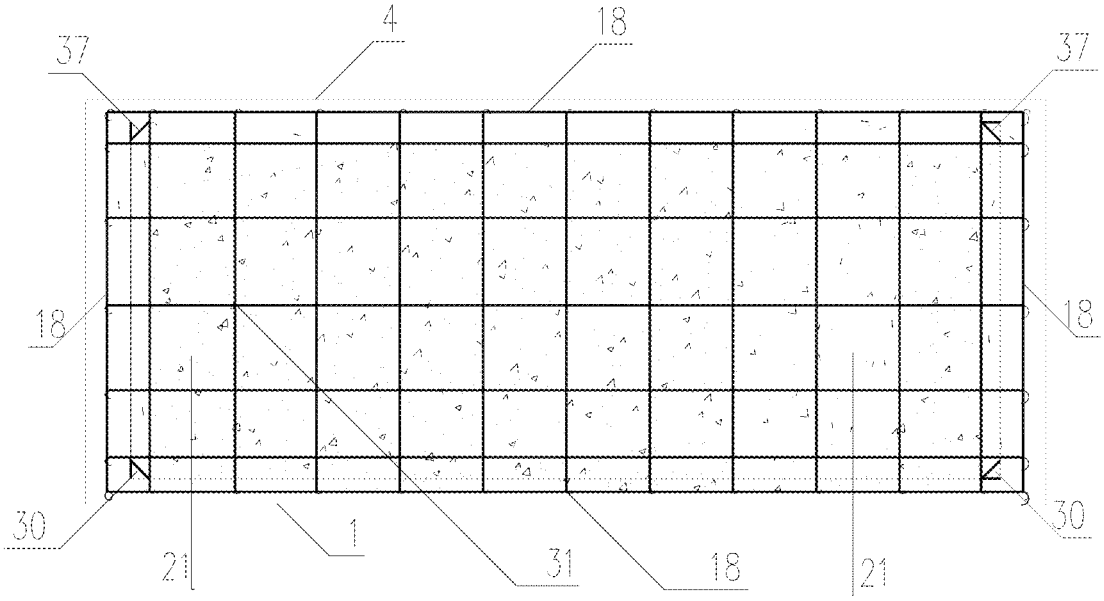
FIG. 6 is a schematic diagram of a steel reinforced concrete sealing wall.

For the reconstruction for the front straight section, a hole is provided on the floor plate 1 as a drainage hole 15, the graded crushed stones 2 are provided at the top of the floor plate 1, the foamed concrete 3 is provided at the top of the graded crushed stones 2. Since the foamed concrete 3 is mass concrete, the foamed concrete 3 is filled in blocks. Both sides of the foamed concrete 3 filled in blocks are fixedly connected to the wood formworks 16, and the bitumastic oakum flexible material 17 is filled within the adjacent wood formworks 16. The wood formworks 16 and the bitumastic oakum flexible material 17 as a whole are used as an expansion joint of the foamed concrete 3. The top of the foamed concrete 3 is fixedly connected to the roof plate 4, the waterproof membrane 5 is laid on the top of the roof plate 4, a clay layer 6 is provided at the top of the waterproof membrane 5, slag 7 is provided and filled in layers on the top of the clay layer 6, a central drainage pipeline 9 is provided therein, and longitudinal drainage pipelines 10 are buried on both sides thereof. A transversal drainage pipeline 14 is provided between the central drainage pipeline 9 and the longitudinal drainage pipelines 10, and the upper of the slag 8 is fixedly connected to the road structure layer 8. A partition wall 11 is provided at the right side of the settlement joint 12, and the waterproof membrane 5 is laid between the right side of the partition wall 11 and the wood formworks 16. The side wall of the original underground garage 19 is provided at the right side of the front straight section, and is fixedly connected to the floor plate 1 and the road structure layer 8, as shown in FIG. 2. The reconstructed partially underground garage 35 includes frame columns 13, and a steel reinforced concrete sealing wall 21 is provided along the frame columns 13. Rebars are embedded inside the frame columns 13, the floor plate 1, and the roof plate 4 to form a steel reinforcement cage 31. An upper support 37 is provided under the roof plate 4, and a lower support 30 is provided on the floor plate 1. The upper support 37 and the lower support 30 are fixedly connected to the steel reinforcement cage 31 to form the steel reinforced concrete sealing wall 21, as shown in FIGS. 5 and 6.

Figure 3:
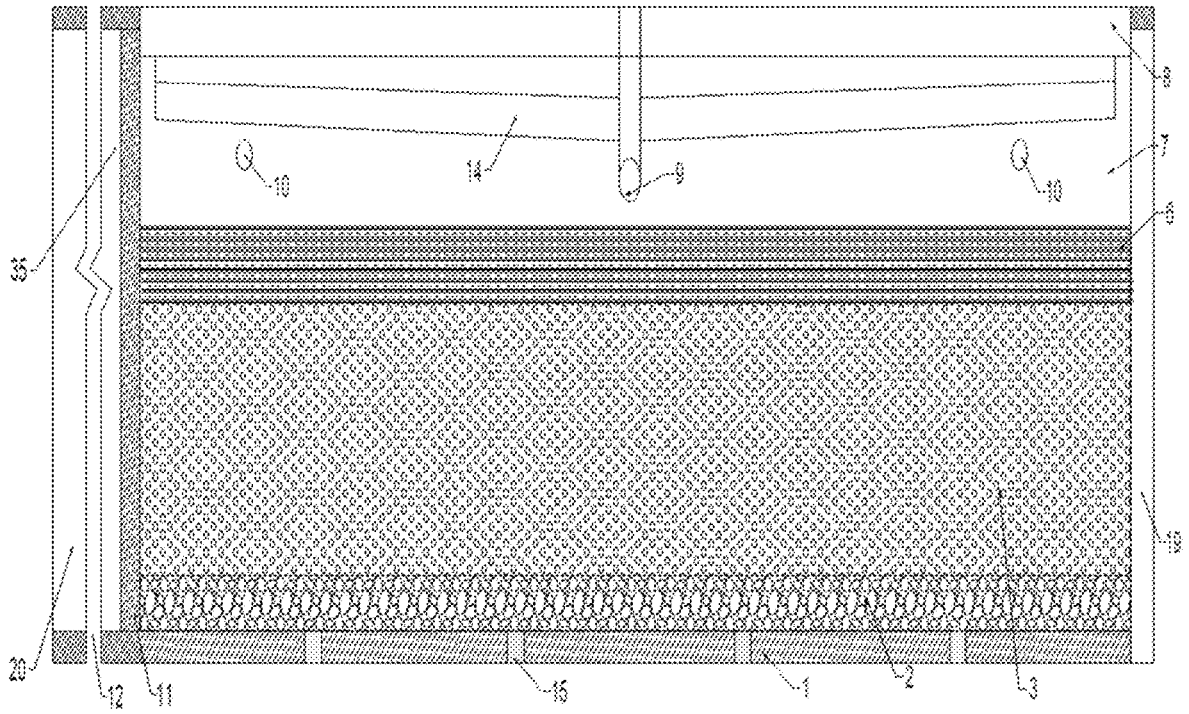
FIG. 3 is a transversal sectional view of a middle section of the road reconstructed from large-scale independent underground garage.
Figure 7:
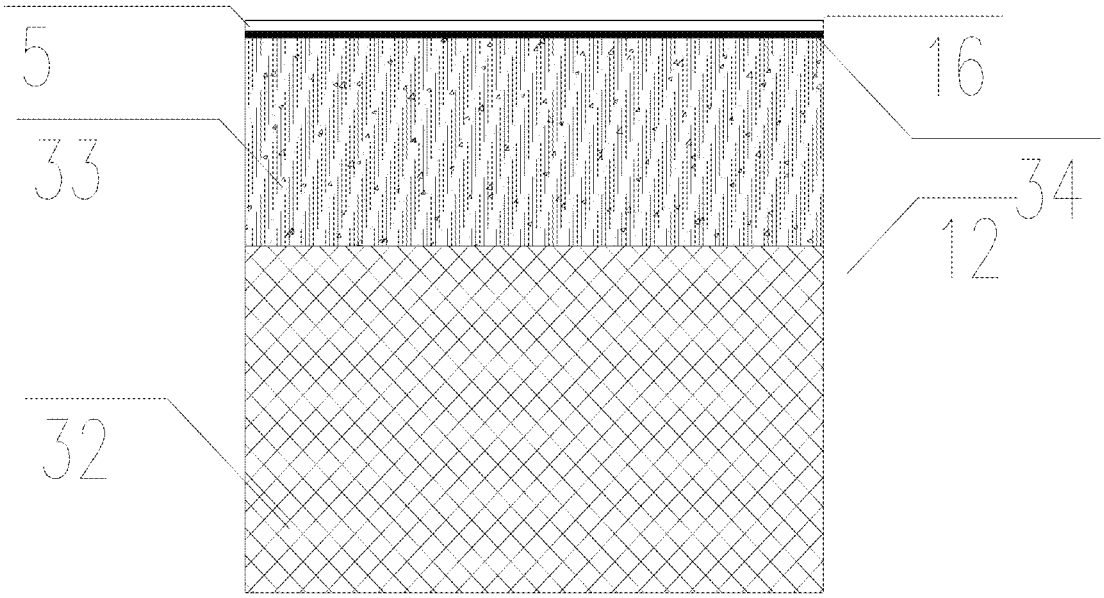
FIG. 7 is a cross-section view of a settlement joint of the road reconstructed from large-scale independent underground garage.

For the reconstruction for the middle transition section, the hole is provided on the floor plate 1 as the drainage hole 15, the graded crushed stones 2 are provided at the top of the floor plate 1, the foamed concrete 3 is provided at the top of the graded crushed stones 2, the clay layer 6 is laid at the top of the foamed concrete 3, the slag 7 is provided and filled in layers on the top of the clay layer 6, the central drainage pipeline 9 is provided therein, and the longitudinal drainage pipelines 10 are buried on both sides thereof. The transversal drainage pipeline 14 is provided between the central drainage pipeline 9 and the longitudinal drainage pipelines 10, and the upper of the slag 7 is fixedly connected to the road structure layer 8. The partially preserved garage 20 is provided at the left side of the middle transition section, the settlement joint 12 is provided between the partially preserved garage 20 and the reconstructed partially underground garage 35, and the partition wall 11 is provided at the right side of the settlement joint 12. The side wall of the original underground garage 19 is provided at the right side of the middle transition section, and is fixedly connected to the floor plate 1 and the road structure layer 8, as shown in FIG. 3. The settlement joint 12 includes foaming agent 32, the cement mortar mixed with lost circulation material 33 is laid on the top of the foaming agent 32, the waterstop strip 34 is fixedly connected to the top of the cement mortar mixed with lost circulation material 33, the waterproof membrane 5 is fixedly connected to the top of the waterstop strip 34, and the wood formworks 16 are fixedly connected to the top of the waterproof membrane 5, as shown in FIG. 7.

Figure 4:
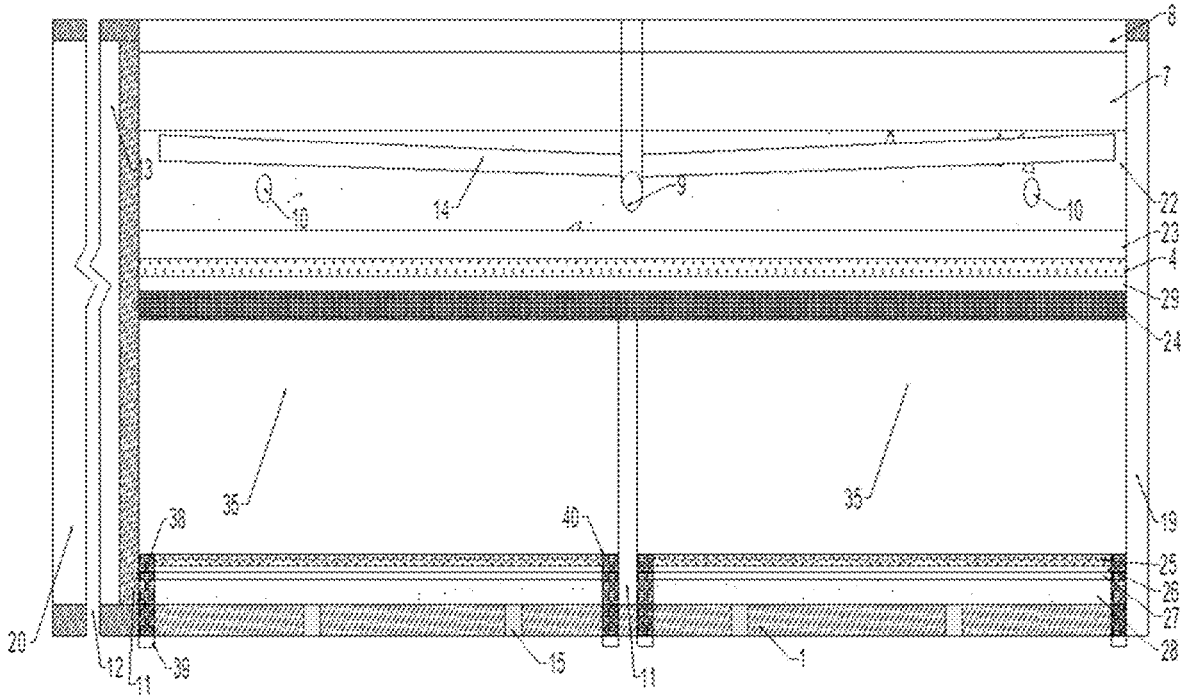
FIG. 4 is a transversal sectional view of a rear section of the road reconstructed from large-scale independent underground garage.
Figure 8:
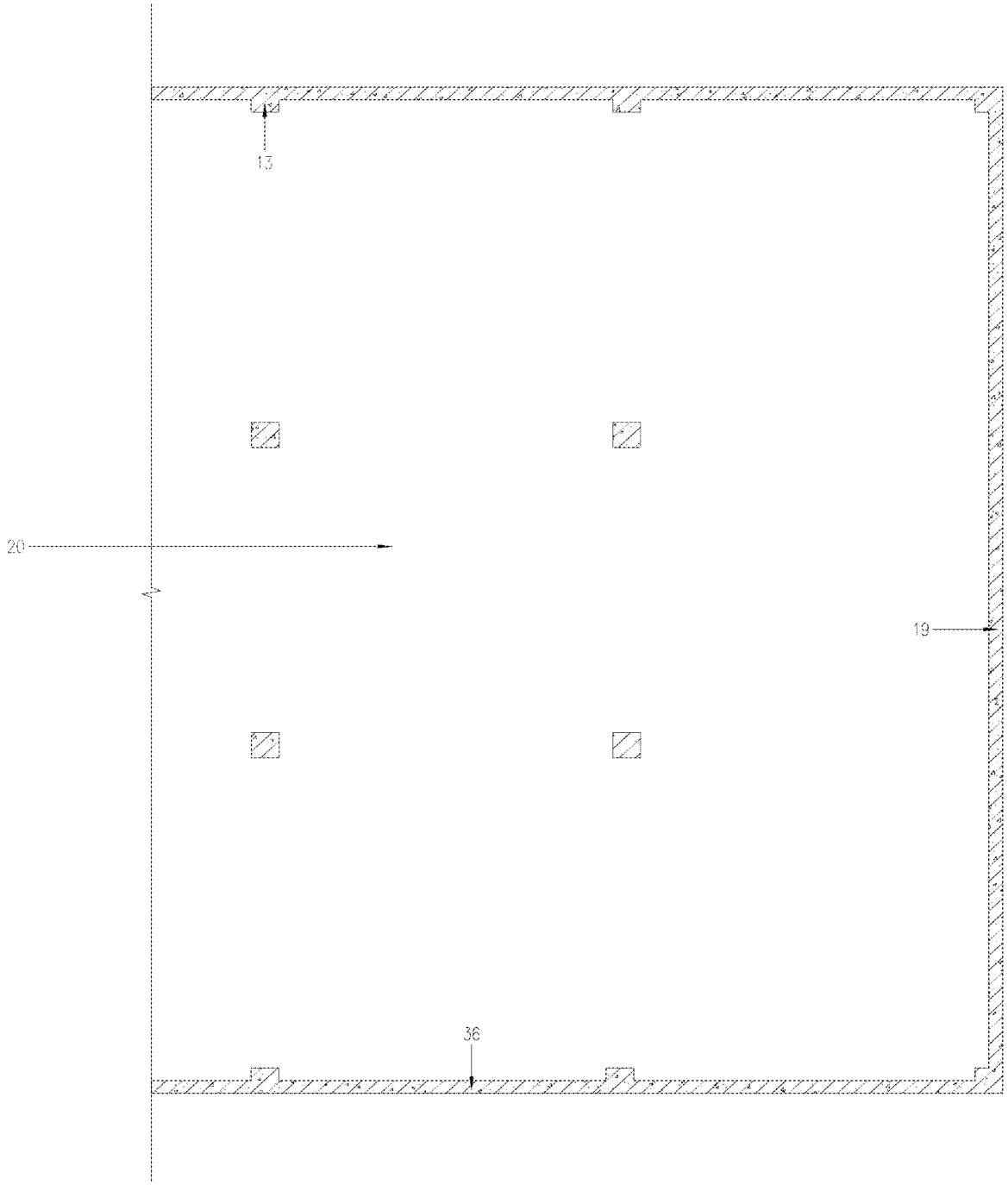
FIG. 8 is a top view of the rear section of the road of the large-scale independent underground garage before reconstruction.
Figure 9:
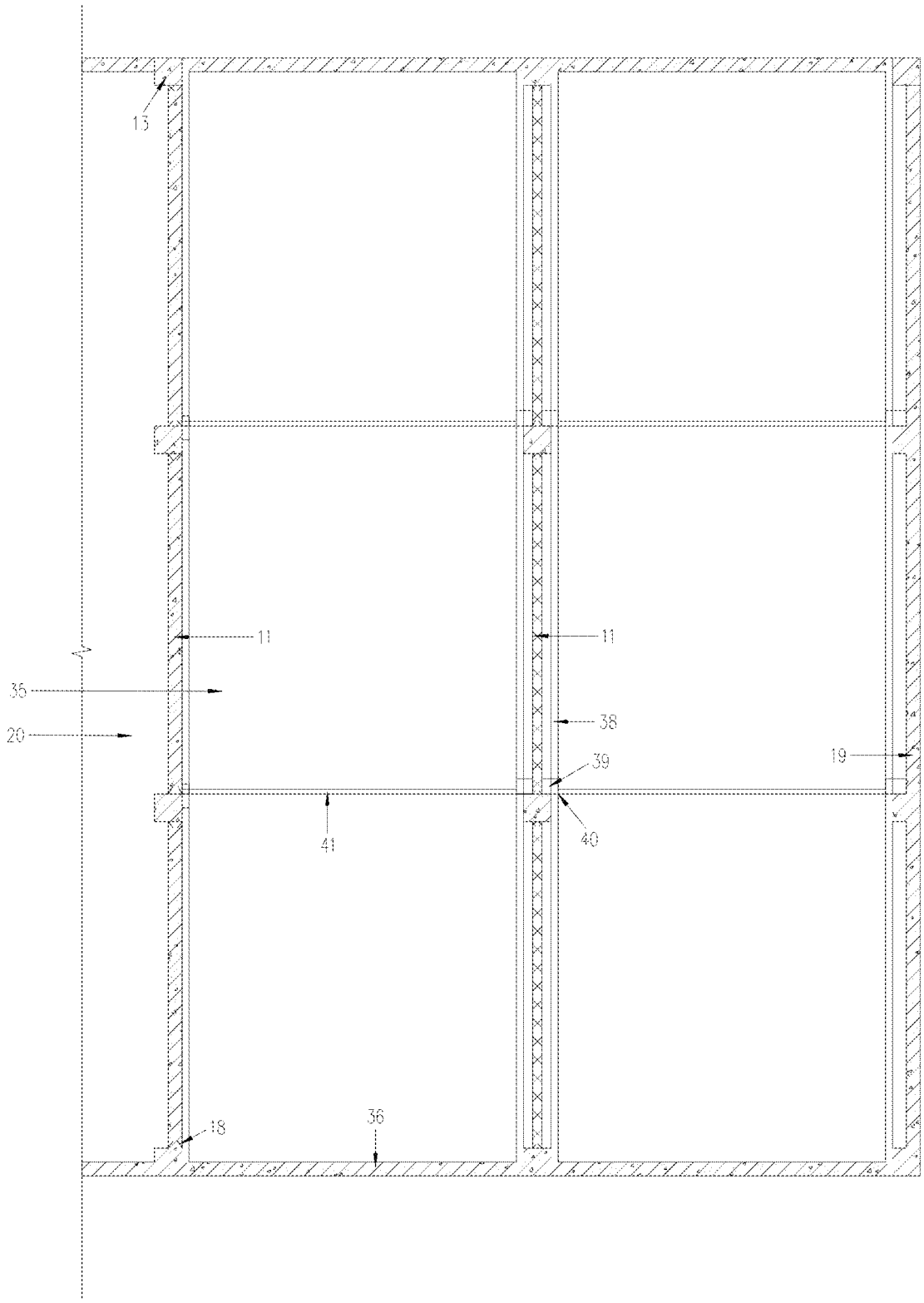
FIG. 9 is a top view of the structure of a double-deck road reconstructed from large-scale independent underground garage.

FIG. 4 is schematic diagram of the reconstruction for the rear section of the road reconstructed from large-scale independent underground garage. FIG. 8 shows the independent underground garage before reconstruction. The reconstructed double-deck road includes the frame columns 13 and rebars 18 inside the frame columns 13. The partition wall 11 is provided along the direction of the road, and a girder 24 is fixedly connected to the upper side of the partition wall 11 in the transverse direction. The upper and lower sides of the roof plate 4 are fixedly connected to an upper plate 23 and a lower plate 29, respectively. The concrete layer 22, the slag 7, and the road structure layer 8 are laid on the upper plate 23 from bottom to top in sequence. The central drainage pipeline 9 is provided inside the concrete layer 22, the longitudinal drainage pipelines 10 are buried on both sides of the concrete layer 22, and the transversal drainage pipeline 14 is provided between the central drainage pipeline 9 and the longitudinal drainage pipelines 10. The road structure subcrust 28, the concrete base 27, the coarse asphalt lower surface course 26, and the fine asphalt surface course 25 are laid on the floor plate 1 of the underground garage. A lower layer drainage system 40 is located inside the concrete base 27, and includes a lower layer horizontal drainage pipe 41, a lower layer longitudinal drainage pipe 38, and an inspection well 39. The lower layer horizontal drainage pipe 41 is laid perpendicular to the direction of the road, the lower layer longitudinal drainage pipe 38 is laid along both sides of the direction of the road, and the inspection well 39 is provided at the connection part of the lower layer horizontal drainage pipe 41 and the lower layer longitudinal drainage pipe 38. The partially preserved garage 20 is provided on the left side of the rear double-deck road section, and the settlement joint 12 is provided between the partially preserved garage 20 and the reconstructed partially underground garage 35. The partition wall 11 is provided at the right side of the settlement joint 12, the side wall of the original underground garage 19 is provided at the right side of the rear double-deck road section, and the side wall of the original underground garage 19 is fixedly connected to the floor plate 1 and the road structure layer 8, as shown in FIGS. 4 and 9.

Example 2

The specific construction method: a newly constructed urban expressway passes through a large-scale independent underground garage, which covers an area of approximately 3023 $m^2$. The large-scale independent underground garage is relatively large, and the main structure has a certain bearing capacity.

In the present disclosure, according to the actual conditions, a segmentation construction method is adopted for construction, and the large-scale independent underground garage is segmented into the front section, the middle section, and the rear sections.

During specific construction, the construction steps are as follows:

S100: segmentation for the large-scale underground garage: the size and the number of segments are determined, based on the structural bearing capacity, surrounding environment of the garage, soil quality, and the importance of the newly constructed road crossing the existing large-scale independent underground garage.

S200: preparation before construction: the materials and equipment required for construction are transported to the site, and the construction site is cleaned.

S300: reconstruction for the front section of the large-scale independent underground garage: according to the construction requirements, the roof plate 4 of the original underground garage is preserved and the front straight section is reconstructed.

S301: providing for the partition wall 11: the partition wall 11 is provided at the side of the settlement joint 12.

S302: providing for the steel reinforced concrete sealing wall 21: the reconstructed partially underground garage 35 includes frame columns 13, the steel reinforced concrete sealing wall 21 is provided along the frame columns 13, rebars are embedded inside the frame columns 13, the floor plate 1, and the roof plate 4 to form the steel reinforcement cage 31, the upper support 37 is provided under the roof plate 4, and the lower support 30 is provided on the floor plate 1, and the upper support 37 and the lower support 30 are fixedly connected to the steel reinforcement cage 31 to form the steel reinforced concrete sealing wall 21.

S303: providing for the drainage hole 15: a hole is opened on the floor plate 1 as the drainage hole 15.

S304: laying for the graded crushed stones 2: the graded crushed stones 2 are laid on the top of the floor plate 1.

S305: providing for the expansion joint: the wood formworks 16 are provided between the frame columns 13, and the bitumastic oakum flexible material 17 is provided between the wood formworks 16.

S306: providing for the waterproof membrane 5: the waterproof membrane 5 is provided at the right side of the frame columns 13 and at the left side of the side wall of the original underground garage 19.

S307: filling for the foamed concrete 3: the foamed concrete 3 is filled in blocks up to the top of the roof plate 4.

S308: laying for the waterproof membrane 5: the waterproof membrane 5 is laid on the top of the roof plate 4.

S309: providing for the clay layer 6: the clay layer 6 is provided on the top of the waterproof membrane 5.

S310: filling for the slag 7 in layers: the slag 7 is filled in layers on the top of the clay layer 6.

S311: burying for the drainage pipeline: the central drainage pipeline 9 is provided inside the slag 7, longitudinal drainage pipelines 10 are buried at both sides of the slag 7, and the transversal drainage pipeline 14 is provided between the central drainage pipeline 9 and the longitudinal drainage pipelines 10.

S312: laying for the road structure layer 8: the road structure layer 8 is laid on the upper part of the slag 7 according to the construction requirements.

S313: providing for the settlement joint 12: the settlement joint 12 is provided between the partially preserved garage 20 and the reconstructed partially underground garage 35.

S400: reconstruction for the middle section of the large-scale independent underground garage: according to the construction requirements, the roof plate 4 and internal columns of the original underground garage is demolished, and the middle transition section is reconstructed.

S401: a part of the roof plate 4 and the frame columns 13 of the original underground garage is demolished.

S402: providing for the partition wall 11: the partition wall 11 is provided on the side of the settlement joint 12.

S403: providing for the steel reinforced concrete sealing wall 21: the reconstructed partially underground garage 35 includes frame columns 13, the steel reinforced concrete sealing wall 21 is provided along the frame columns 13, rebars are embedded inside the frame columns 13, the floor plate 1, and the roof plate 4 to form the steel reinforcement cage 31, the upper support 37 is provided under the roof plate 4, and the lower support 30 is provided on the floor plate 1, and the upper support 37 and the lower support 30 are fixedly connected to the steel reinforcement cage 31 to form the steel reinforced concrete sealing wall 21.

S404: providing for the drainage hole 15: a hole is opened on the floor plate 1 as the drainage hole 15.

S405: laying for the graded crushed stones 2: the graded crushed stones 2 are laid on the top of the floor plate 1.

S406: filling for the foamed concrete 3: the foamed concrete 3 is filled in layers.

S407: providing for the clay layer 6: the clay layer 6 is provided at the top of the foamed concrete 3.

S408: filling for the slag 7 in layers: the slag 7 is filled in layers on the top of the clay layer 6.

S409: burying for the drainage pipeline: the central drainage pipeline 9 is provided inside the slag 7, the longitudinal drainage pipelines 10 are buried at both sides of the slag 7, and the transversal drainage pipeline 14 is provided between the central drainage pipeline 9 and the longitudinal drainage pipelines 10.

S410: laying for the road structure layer 8: the road structure layer 8 is laid on the upper of the slag 7 according to the construction requirements.

S411: providing for the settlement joint 12: the settlement joint 12 is provided between the partially preserved garage 20 and the reconstructed partially underground garage 35, the settlement joint 12 includes foaming agent 32, the cement mortar mixed with lost circulation material 33 is laid on the foaming agent 32 and, the waterstop strip 34 is fixedly connected to the top of the cement mortar mixed with lost circulation material 33, the waterproof membrane 5 is fixedly connected to the top of the waterstop strip 34, and the wood formworks 16 are fixedly connected to the top of the waterproof membrane 5.

S500: reconstruction for the rear section of the large-scale independent underground garage: according to the construction requirements, the rear section road is reconstructed into a double-deck road.

S501: shattering for the wall: according to the requirements, the exterior wall 36 of the reconstructed partially underground garage 35 on the opposite side of the road is shattered, and the side wall of the original underground garage 19 and the partially preserved garage 20 are preserved.

S502: providing for the partition wall 11 and the girder 24: the frame columns 13 between the reconstructed part and the preserved part is preserved on the side of the preserved part, rebars 18 are provided at the frame columns 13 of the reconstructed partially underground garage 35, the rebars are bound along the direction of the road, and the concrete is poured to form the partition wall 11, and the girder 24 is poured in the transverse direction on the upper side of the partition wall 11.

S503: reconstruction for the roof plate 4: the upper and lower sides of the roof plate 4 of the reconstructed partially underground garage 35 are all roughened, the upper and lower sides of the roof plate 4 are bound with rebar meshes, the formworks are laid on the upper and lower sides and the concrete is poured to form the upper plate 23 and the lower plate 29.

S504: reconstruction for the upper layer of the road: the concrete layer 22, the slag 7, and the road structure layer 8 are laid on the newly poured upper plate 23 from bottom to top in sequence to form the upper layer of the road.

S505: burying for the upper drainage pipe: the central drainage pipeline 9 is provided inside the concrete layer 22, the longitudinal drainage pipelines 10 are buried on both sides of the concrete layer 22, and the transversal drainage pipeline 14 is provided between the central drainage pipeline 9 and the longitudinal drainage pipelines 10.

S506: reconstruction for the lower layer of the road: the road structure subcrust 28, the concrete base 27, the coarse asphalt lower surface course 26, and the fine asphalt surface course 25 are laid on the floor plate 1 of the underground garage in sequence.

S507: burying for the lower drainage pipe: the lower layer drainage system 40 is laid inside the concrete base 27, and includes the lower layer horizontal drainage pipe 41, the lower layer longitudinal drainage pipe 38, and the inspection well 39, the lower layer horizontal drainage pipe 41 is laid perpendicular to the direction of the road, the lower layer longitudinal drainage pipe 38 is laid along both sides of the direction of the road, and the inspection well 39 is provided at the connection part of the lower layer horizontal drainage pipe 41 and the lower layer longitudinal drainage pipe 38.

What is claimed is:

1. A road structure reconstructed from large-scale independent underground garage, comprising a front straight section, a middle transition section, and a rear double-deck road section, wherein a settlement joint (12) is provided both between the front straight section and the middle transition section and between the middle transition section and the rear double-deck road section, wherein the front straight section comprises a floor plate (1), a drainage hole (15) is provided in the floor plate (1), graded crushed stones (2) are provided on the floor plate (1), foamed concrete (3) is filled in blocks on the graded crushed stones (2), a wood formworks (16) fixedly is provided at each side of each block of the foamed concrete (3), a bitumastic oakum flexible material (17) is filled between adjacent wood formworks (16), a top of the foamed concrete (3) is fixedly connected to a roof plate (4), a waterproof membrane (5) is laid on the roof plate (4), a clay layer (6) is provided on the waterproof membrane (5), slag (7) is provided on the clay layer (6) and is filled in layers, a central drainage pipeline (9) is provided inside the slag (7), longitudinal drainage pipelines (10) are buried at both sides of the slag (7), a transversal drainage pipeline (14) is provided between the central drainage pipeline (9) and the longitudinal drainage pipelines (10), and a road structure layer (8) is fixedly connected with an upper part of the slag (7), a partially preserved garage (20) is provided on a left side of the front straight section, the settlement joint (12) is provided between the partially preserved garage (20) and a reconstructed partially underground garage (35), the reconstructed partially underground garage (35) comprises frame columns (13), a steel reinforced concrete sealing wall (21) is provided along the frame columns (13), rebars are embedded inside the frame columns (13), the floor plate (1), and the roof plate (4) to form a steel reinforcement cage (31), an upper support (37) is provided under the roof plate (4), and a lower support (30) is provided on the floor plate (1), the upper support (37) and the lower support (30) are fixedly connected to the steel reinforcement cage (31) to form the steel reinforced concrete sealing wall (21), a partition wall (11) is provided at a right side of the settlement joint (12), and the waterproof membrane (5) is laid between a right side of the partition wall (11) and the wood formworks (16), a side wall (19) of an original underground garage is provided at a right side of the front straight section and the side wall (19) of the original underground garage is fixedly connected to the floor plate (1) and the road structure layer (8), wherein the middle transition section comprises the floor plate (1), the drainage hole (15) is provided in the floor plate (1), the graded crushed stones (2) are provided on the floor plate (1), the foamed concrete (3) is provided on the graded crushed stones (2), the clay layer (6) is laid at the top of the foamed concrete (3), the slag (7) is provided and filled in layers on the clay layer (6), the central drainage pipeline (9) is provided inside the slag (7), the longitudinal drainage pipelines (10) are buried at both sides of the slag (7), the transversal drainage pipeline (14) is provided between the central drainage pipeline (9) and the longitudinal drainage pipelines (10), an upper part of the slag (7) is fixedly connected to the road structure layer (8), the partially preserved garage (20) is provided on a left side of the middle transition section, the settlement joint (12) is provided between the partially preserved garage (20) and the reconstructed partially underground garage (35), the partition wall (11) is provided at the right side of the settlement joint (12), the side wall (19) of the original underground garage is provided at a right side of the middle transition section, the side wall (19) of the original underground garage is fixedly connected to the floor plate (1) and the road structure layer (8), the settlement joint (12) comprises foaming agent (32), cement mortar mixed with lost circulation material (33) is laid on the foaming agent (32), a waterstop strip (34) is fixedly connected to a top of the cement mortar mixed with the lost circulation material (33), the waterproof membrane (5) is fixedly connected to a top of the waterstop strip (34), and the wood formworks (16) are fixedly connected to a top of the waterproof membrane (5), wherein the rear double-deck road section comprises the frame columns (13), rebars (18) are embedded inside the frame columns (13), the partition wall (11) provided along a road direction, a girder (24) is fixedly connected to an upper side of the partition wall (11) in a transverse direction, an upper of the roof plate (4) is fixedly connected to an upper plate (23) and an lower side of the roof plate (4) is fixedly connected to a lower plate (29), a concrete layer (22), the slag (7), the road structure layer (8) are laid on the upper plate (23) from bottom to top in sequence, the central drainage pipeline (9) is provided inside the concrete layer (22), the longitudinal drainage pipelines (10) buried on both sides of the concrete layer (22), the transversal drainage pipeline (14) is provided between the central drainage pipeline (9) and the longitudinal drainage pipelines (10), a road structure subcrust (28), a concrete base (27), a coarse asphalt lower surface course (26), and a fine asphalt surface course (25) are laid on the floor plate (1) in sequence, a lower layer drainage system (40) is provided inside the concrete base (27), and comprises a lower layer horizontal drainage pipe (41), a lower layer longitudinal drainage pipe (38), and an inspection well (39), the lower layer horizontal drainage pipe (41) is laid perpendicular to a direction of the road, the lower layer longitudinal drainage pipe (38) is laid along both sides of the direction of the road, and the inspection well (39) is provided at a connection part of the lower layer horizontal drainage pipe (41) and the lower layer longitudinal drainage pipe (38), the partially preserved garage (20) is provided on a left side of the rear double-deck road section, the settlement joint (12) is provided between the partially preserved garage (20) and the reconstructed partially underground garage (35), the partition wall (11) is provided at the right side of the settlement joint (12), the side wall of the original underground garage (19) is provided at a right side of the rear double-deck road section, and the right side (19) of the rear double-deck road section is fixedly connected to the floor plate (1) and the road structure layer (8).

2. The road structure reconstructed from large-scale independent underground garage according to claim 1, wherein the foamed concrete (3) is provided at a top of the graded crushed stone (2), and the foamed concrete (3) is filled in blocks with foamed concrete material.

3. The road structure reconstructed from large-scale independent underground garage according to claim 1, wherein the girder (24), the upper plate (23) and the lower plate (29) are all poured with high-strength concrete, and rebars in the lower plate (29) are pre-stressed rebars.

4. A construction method for the road structure reconstructed from large-scale independent underground garage according to claim 1, comprising the following steps:

S100: segmentation for the large-scale underground garage, comprising: determining a size and a number of segments, based on structural bearing capacity, surrounding environment, and soil quality of the garage,

S200: preparation before construction, comprising: transporting materials and equipment required for construction to a site, and cleaning construction site,

S300: reconstruction for a front section of the large-scale independent underground garage, comprising: preserving a roof plate (4) of the original underground garage, and reconstructing the front straight section, according to construction requirements,

S400: reconstruction for a middle section of the large-scale independent underground garage, comprising: demolishing the roof plate (4) and internal columns of the original underground garage, and reconstructing the middle transition section, according to the construction requirements,

S500: reconstruction for a rear section of the large-scale independent underground garage, comprising: the rear section road is reconstructed into a double-deck road according to the construction requirements.

5. The construction method for the road structure reconstructed from large-scale independent underground garage according to claim 4, wherein the step S300 comprises the following sub-steps:

S301: providing the partition wall (11), comprising: providing the partition wall (11) at a side of a settlement joint (12),

S302: providing the steel reinforced concrete sealing wall (21), wherein a reconstructed partially underground garage (35) comprises frame columns (13), and the steel reinforced concrete sealing wall (21) is provided along the frame columns (13), embedding rebars inside the frame columns (13), the floor plate (1), and the roof plate (4) to form a steel reinforcement cage (31), the upper support (37) is provided under the roof plate (4), and the lower support (30) is provided on the floor plate (1), and the upper support (37) and the lower support (30) are fixedly connected to the steel reinforcement cage (31) to form the steel reinforced concrete sealing wall (21),

S303: providing the drainage hole (15), comprising: opening a hole as the drainage hole (15) on the floor plate (1),

S304: laying the graded crushed stone (2), comprising: laying the graded crushed stone (2) on a top of the floor plate (1),

S305: providing an expansion joint, comprising: providing wood formworks (16) between the frame columns (13), and providing bitumastic oakum flexible material (17) between the wood formworks (16),

S306: providing the waterproof membrane (5), comprising: providing the waterproof membrane (5) at a right side of the frame columns (13) and a left side of the side wall (19) of the original underground garage,

S307: filling the foamed concrete (3), comprising: filling the foamed concrete (3) in blocks up to a top of the roof plate (4), S308: laying for the waterproof membrane (5), comprising: laying the waterproof membrane (5) on the top of the roof plate (4), S309: providing the clay layer (6), comprising: providing the clay layer (6) at the top of the waterproof membrane (5), S310: filling the slag (7) in layers, comprising: filling the slag (7) in layers at a top of the clay layer (6), S311: burying the drainage pipeline, comprising: providing the central drainage pipeline (9) inside the slag (7), burying the longitudinal drainage pipelines (10) at both sides of the slag (7), and providing the transversal drainage pipeline (14) between the central drainage pipeline (9) and the longitudinal drainage pipelines (10), S312: laying the road structure layer (8), comprising: laying the road structure layer (8) on the upper part of the slag (7) according to construction requirements, S313: providing for the settlement joint (12), comprising: providing the settlement joint (12) between the partially preserved garage (20) and the reconstructed partially underground garage (35).

6. The construction method for the road structure reconstructed from large-scale independent underground garage according to claim 4, wherein the step S400 comprises the following sub-steps:

S401: demolishing a part of the roof plate (4) and the frame columns (13) of the original underground garage, S402: providing a partition wall (11), comprising: providing the partition wall (11) on a side of the settlement joint (12), S403: providing a steel reinforced concrete sealing wall (21), wherein reconstructed partially underground garage (35) comprises the frame columns (13), the steel reinforced concrete sealing wall (21) is provided along the frame columns (13), rebars are embedded inside the frame columns (13), the floor plate (1), and the roof plate (4) to form a steel reinforcement cage (31), the upper support (37) is provided under the roof plate (4), and the lower support (30) is provided on the floor plate (1), the upper support (37) and the lower support (30) are fixedly connected to the steel reinforcement cage (31) to form the steel reinforced concrete sealing wall (21), S404: providing the drainage hole (15), comprising: opening a hole as the drainage hole (15) on the floor plate (1), S405: laying the graded crushed stone (2), comprising: laying the graded crushed stone (2) on a top of the floor plate (1), S406: filling the foamed concrete (3), comprising: filling the foamed concrete (3) in layers, S407: providing the clay layer (6), comprising: providing the clay layer (6) at the top of the foamed concrete (3), S408: filling the slag (7) in layers, comprising: filling the slag (7) in layers on a top of the clay layer (6), S409: burying the drainage pipeline, comprising: providing a central drainage pipeline (9) inside the slag (7), burying the longitudinal drainage pipelines (10) at both sides of the slag (7), and providing the transversal drainage pipeline (14) between the central drainage pipeline (9) and the longitudinal drainage pipelines (10), S410: laying the road structure layer (8), comprising: laying the road structure layer (8) on the upper part of the slag (7) according to construction requirements, S411: providing the settlement joint (12), comprising: providing the settlement joint (12) between the partially preserved garage (20) and the reconstructed partially underground garage (35), wherein the settlement joint (12) comprises foaming agent (32), laying cement mortar mixed with lost circulation material (33) on the foaming agent (32), fixedly connecting the waterstop strip (34) to the cement mortar mixed with the lost circulation material (33), fixedly connecting the waterproof membrane (5) to the top of the waterstop strip (34), and fixedly connecting wood formworks (16) to the top of the waterproof membrane (5).

7. The construction method for the road structure reconstructed from large-scale independent underground garage according to claim 4, wherein the step S500 comprises the following sub-steps:

S501: shattering a wall, comprising: shattering, according to requirements, an exterior wall (36) of the reconstructed partially underground garage (35) opposite to the road, and preserving the side wall (19) of the original underground garage and the partially preserved garage (20), S502: providing the partition wall (11) and the girder (24), comprising: preserving frame columns (13) between a reconstructed part and a preserved part on a side of the preserved part, providing bonded rebars (18) at the frame columns (13) of the reconstructed partially underground garage (35), binding the rebars along the direction of the road, and pouring concrete to form the partition wall (11), and pouring the girder (24) on the upper side of the partition wall (11) in the transverse direction, S503: reconstruction for the roof plate (4), comprising: roughening both the upper and lower sides of the roof plate (4) of the reconstructed partially underground garage (35), binding the upper and lower sides of the roof plate (4) with rebar meshes, laying formworks on the upper and lower sides of the roof plate (4), and pouring the concrete to form the upper plate (23) and the lower plate (29), S504: reconstruction for an upper layer of the road, comprising: laying the concrete layer (22), the slag (7), and the road structure layer (8) on the newly poured upper plate (23) from bottom to top in sequence to form the upper layer of the road, S505: burying for an upper drainage pipe, comprising: providing the central drainage pipeline (9) inside the concrete layer (22), burying the longitudinal drainage pipelines (10) buried on both sides of the concrete layer (22), and providing the transversal drainage pipeline (14) between the central drainage pipeline (9) and the longitudinal drainage pipelines (10), S506: reconstruction for a lower layer of the road, comprising: laying the road structure subcrust (28), the concrete base (27), the coarse asphalt lower surface course (26), and the fine asphalt surface course (25) on the floor plate (1) of the underground garage in sequence, S507: burying for a lower drainage pipe, comprising: laying the lower layer drainage system (40) inside the concrete base (27), wherein the lower layer drainage system (40) comprises the lower layer horizontal drainage pipe (41), the lower layer longitudinal drainage pipe (38), and the inspection well (39), laying the lower layer horizontal drainage pipe (41) perpendicular to the direction of the road, laying the lower layer longitudinal drainage pipe (38) along both sides of the direction of the road, and providing the inspection well (39) at the connection part of the lower layer horizontal drainage pipe (41) and the lower layer longitudinal drainage pipe (38).

* * * * *